US007100346B2

(12) United States Patent
Kotzur et al.

(10) Patent No.: US 7,100,346 B2
(45) Date of Patent: Sep. 5, 2006

(54) MACHINE FOR BOXING WOUND COILS OF FILAMENTARY MATERIAL

(75) Inventors: Frank W. Kotzur, Carmel, NY (US); David B. Franklin, Carmel, NY (US); Brian P. Moore, Newburgh, NY (US); Gregory A. Kotzur, Stanfordville, NY (US)

(73) Assignee: Windings, Inc., Patterson, NY (US)

( * ) Notice: Subject to any disclaimer, the term of this patent is extended or adjusted under 35 U.S.C. 154(b) by 0 days.

(21) Appl. No.: 10/851,126

(22) Filed: May 24, 2004

(65) Prior Publication Data

US 2005/0097862 A1 May 12, 2005

Related U.S. Application Data

(63) Continuation of application No. 09/853,862, filed on May 14, 2001, now Pat. No. 6,766,627.

(51) Int. Cl.
*B65B 63/04* (2006.01)

(52) U.S. Cl. ..... 53/118; 53/128.1; 53/133.1; 53/430; 53/485; 53/489; 53/566; 53/574; 53/581; 53/376.5; 242/171; 242/125.3

(58) Field of Classification Search ..... 53/133.1, 53/116, 118, 430, 456, 458, 484, 485, 489, 53/566, 574, 581, 376.3, 376.5, 377.3, 128.1; 242/163, 164, 171, 125.3
See application file for complete search history.

(56) References Cited

U.S. PATENT DOCUMENTS 2,634,918 A * 4/1953 Van Horn Whipple et al. ..... 242/478
3,061,238 A * 10/1962 Taylor, Jr. ..... 242/163
3,589,096 A * 6/1971 Podvin ..... 53/493
3,677,490 A * 7/1972 Gordon et al. ..... 242/163
4,313,579 A * 2/1982 Zuber et al. ..... 242/163
5,624,528 A * 4/1997 Abrams et al. ..... 156/556
5,678,778 A * 10/1997 Kotzur et al. ..... 242/474.4

* cited by examiner

*Primary Examiner*—John Sipos
*Assistant Examiner*—Christopher Harmon
(74) *Attorney, Agent, or Firm*—R. J. Lasker, Esq.; Intellectual Property Law Firm of R. J. Lasker, Esq.

(57) ABSTRACT

A machine for winding and boxing wound coils of filamentary material having a payout hole extending from the outer to the inner coil winding wherein a turret mechanism mounting two oppositely disposed end forms and corresponding collapsible mandrels and operative between first and second stations, wherein the first station enables filamentary material to be wound on one of the mandrels and associated end form and a second station wherein the mandrel and end form containing the wound coil is rotated to confront a boxing station; a boxing station including a platform having a movable back panel, a base panel and an inclined ramp facing the second station and being movable towards and away from the second station for receiving the wound coil from the collapsible mandrel; the boxing station receiving an unfolded box deposited on the base panel with a back panel folded against said back panel and including means for folding two opposite side panels of the box to enable reception of the wound coil in the partially assembled box; payout tube inserting means for inserting a payout tube in the payout hole of the wound coil through a payout hole in the top panel of the box and including means for grasping the free end of the wound coil and withdrawing it through the payout tube; and the boxing station including means for folding, gluing and sealing the flaps of the box.

9 Claims, 15 Drawing Sheets

MACHINE FOR BOXING WOUND COILS OF FILAMENTARY MATERIAL

BACKGROUND OF THE INVENTION

This application is a continuation of Ser. No. 09/853,862 filed May 14, 2001 now U.S. Pat. 6,766,627.

1. Field of the Invention

This invention relates to method and apparatus for winding and boxing wound coils of filamentary material, and more particularly to such method and apparatus for automatically inserting a payout tube into a radial opening in a wound coil of filamentary material, threading an end portion of the filamentary material through the payout tube, inserting the wound coil into a container and securing the end of the withdrawn filamentary material on the container, and closing the flaps of the container, sealing the container and removing the container from the machine.

2. Related Art

The following patents each disclose container structure for retaining a wound coil of filamentary material for feedout through a radial opening in the wound coil and out of the container.

U.S. Pat. No. 3,677,491 to Gerwig discloses a package for a wind of flexible material and having end-forming flaps hinged about axes perpendicular to the axial opening of the wind. Truncated pyramids project inwardly from the end walls to control the unwinding of the coil and are formed by the folding of a blank of cardboard having extending flaps interleaved with the end flaps of the box to hold the pyramids in position.

U.S. Pat. No. 3,748,817 to Newman discloses a package of a compressed wind with the end walls substantially perpendicular to the longitudinal axis of the package.

U.S. Pat. No. 3,923,270 to Newman et al. discloses a package provided with tapering members within the axial opening to guide the individual coils of the material as they are withdrawn, in the space between the cone and the inner wall there is arranged a removable solid material which is held against the inside coils of the package.

U.S. Pat. No. 3,985,315 discloses a package for containing a wound coil with a funnel having a stem positioned in the radial opening and with the mouth thereof substantially at the midplane of the package.

U.S. Pat. No. 4,019,636 to Wise discloses a carton having a series of connected walls forming a perimeter around the coil and each of the walls has opposed hinged flaps. Tabs located on the edge of each flap opposite the hinged connection and the tabs on each side of the coil interlock to form a tapered boss extending into the open center of the coil spaced from, but facing, the like opposing boss.

U.S. Pat. No. 4,160,533 to Kotzur et al discloses a container having an octagonal insert and corner payout and includes a feedout tube inserted in the radial hole of the wind. Opposite sides of the insert engage the inner surfaces of the container. The bottom and upper surfaces of the container include intersecting cone sections for supporting the inner windings of the wound filamentary material.

As is evident from a consideration of the above prior art there is a need for improved method and apparatus for automating the packaging of wound coils.

SUMMARY OF THE INVENTION

It is a primary object of the present invention to provide a method and apparatus for automatically winding and packaging wound coils of filamentary material in a container including a payout tube for paying out the wound coil through a radial opening in the coil and an aligned opening in the container retaining the payout tube.

It is a primary feature and advantage of the present invention that a wound coil of filamentary material may be automatically packaged in a wound coil having a radial opening for receiving a payout tube and through which the wound filamentary material is withdrawn from an aligned opening in the container.

Yet another object of the present invention is to provide method and apparatus for loading a wound coil of filamentary material, having a payout hole extending through the coil from the outermost wind to the innermost wind, from a turret station where the filamentary material is wound, and for positioning the wound coil for movement of the wound coil to a boxing station.

It is a feature and advantage of the present invention that the wound coil with a payout hole is positioned for reception of a payout tube in the payout hole and the free end of the wound coil is secured to be subsequently grasped and pulled through the payout tube to the outside of the wound coil and the container.

It is another object, feature and advantage of the subject invention that, in a method and apparatus for winding and packaging coils of filamentary material, a rotating turret mechanism is employed wherein the coil may be wound and then subsequently the wound coil is rotated into a position where the wound coil is located in a boxing station wherein the flaps of the container are folded around the wound coil and the payout tube is automatically inserted through an opening in the container and into the radial opening such that a free end of the coil is grasped and removed through the payout tube and the opening to the exterior of the container.

It is yet a further object of the present invention to provide both method and apparatus for automatically folding the flaps of a container around the wound coil and applying adhesive thereto to form the container.

It is yet a further feature and advantage of the present invention that the flaps of the container containing the wound coil of filamentary material are automatically glued and folded.

It is still another object of the present invention to provide both method and apparatus for automatically removing the packaged container of wound filamentary material from the packaging apparatus.

It is still another feature and advantage of the present method and apparatus that the container of wound filamentary material is automatically removed from the packaging apparatus.

The boxing machine of the present invention includes a rotating turret station where the coil of filamentary material is wound and then rotated and positioned at a payout tube insertion and boxing station wherein the various flaps of the container are folded around the wound coil. This station includes means for placing a payout tube into position for being inserted through a flap in the container and into the radial opening in the wound coil whereby an exposed end of the wound coil is grasped and removed through the payout tube to the exterior of the container. During this operation another coil is being wound at the opposite side of the turret for subsequent rotation to the payout tube insertion and boxing station. Various sensors provide signals to a programmer for controlling the winding of the coil, the movement of the turret, the operation of the payout tube insertion operation and the gluing and folding of the various flaps of the container to form the box enclosing the wound coil.

BRIEF DESCRIPTION OF THE DRAWINGS

The above objects, features and advantages are readily apparent from the following description of a preferred embodiment of the best mode for carrying out the invention when taken in conjunction with the following drawings, wherein.

DETAILED DESCRIPTION

Figure 1:
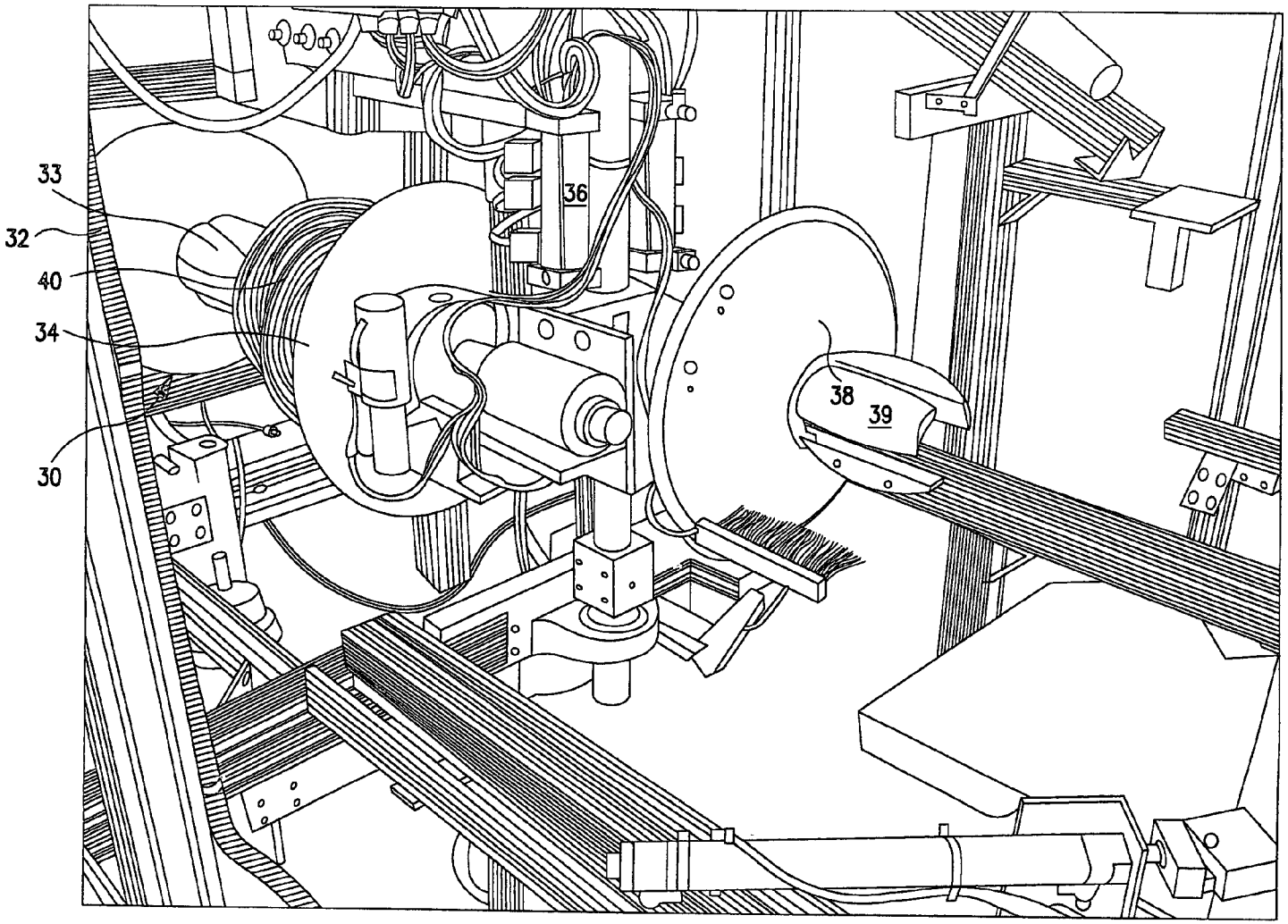
FIG. 1 shows a perspective view of the major components of the turret, including the coil winding station, and the payout tube insertion and packaging station according to a preferred embodiment of the present invention.

The boxing machine of the present invention includes a filamentary material winding station 30 in which an end form 32, including a collapsible mandrel 33, is positioned in opposing operating relationship to a second end form 34, including a collapsible mandrel (not shown) is mounted to a rotating turret assembly 36, which also includes a third end form 38 and an associated collapsible mandrel 39. The wound coil 40 is shown having been wound on the collapsible mandrel 33, 35, end from 32, 34 structure by a winding mechanism well known to those skilled in the art. For an example of the coil winding process and machinery see Windings' U.S. Pat. Nos. 4,741,495, 5,413,264 and 5,678,778.

The turret assembly shown in FIG. 1 is ready to rotate 180 degrees so that the wound coil 40 occupies the position of end form 38 and collapsible mandrel 39 and facing a wound coil loading station (not shown, but described below). In addition to mechanism for rotating the turret, the turret assembly also includes mechanism for controlling the collapsing and opening of the collapsible mandrels and for grasping and securing a free end of the filamentary material for winding a coil. For the purposes of this invention it is understood that all such mechanism is known to those skilled in the winding art.

Figure 2:
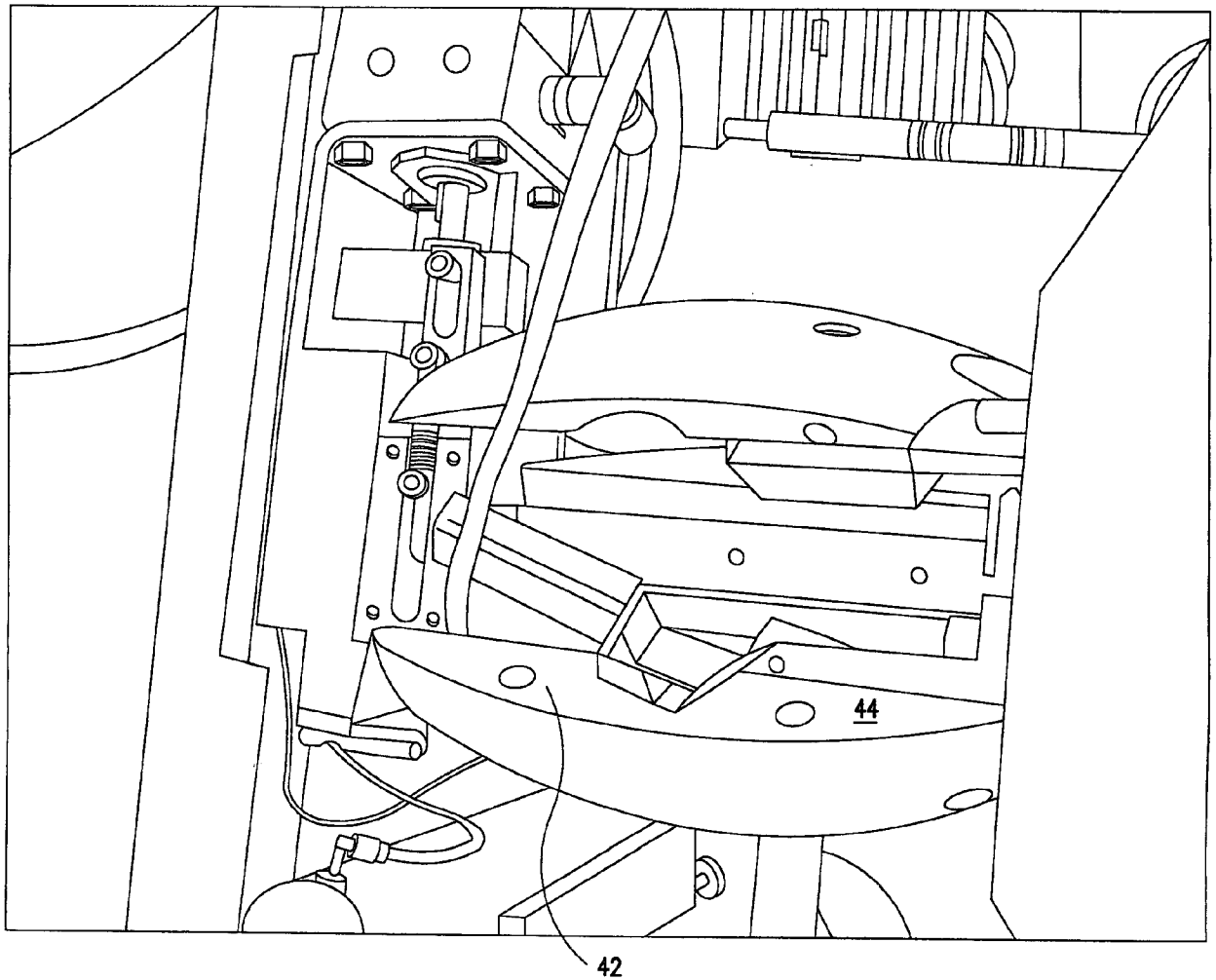
FIG. 2 shows the filamentary material entering the jaws of the opened clamp at the end of the collapsible mandrel as the mandrel and the end form are moved towards the filamentary material.
Figure 3:
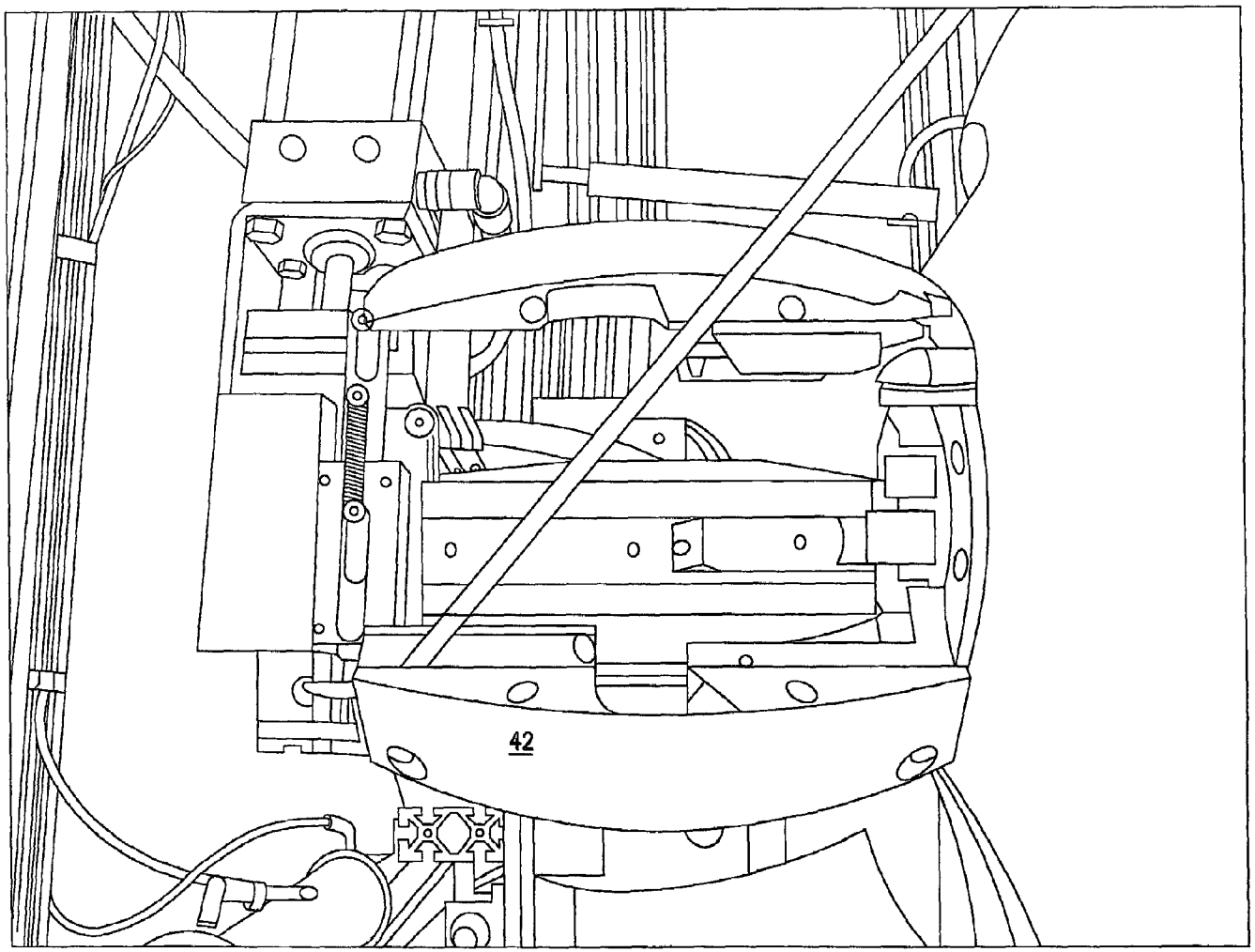
FIG. 3 shows the filamentary material grasped by the jaws of the clamp which are now closed.
Figure 4:
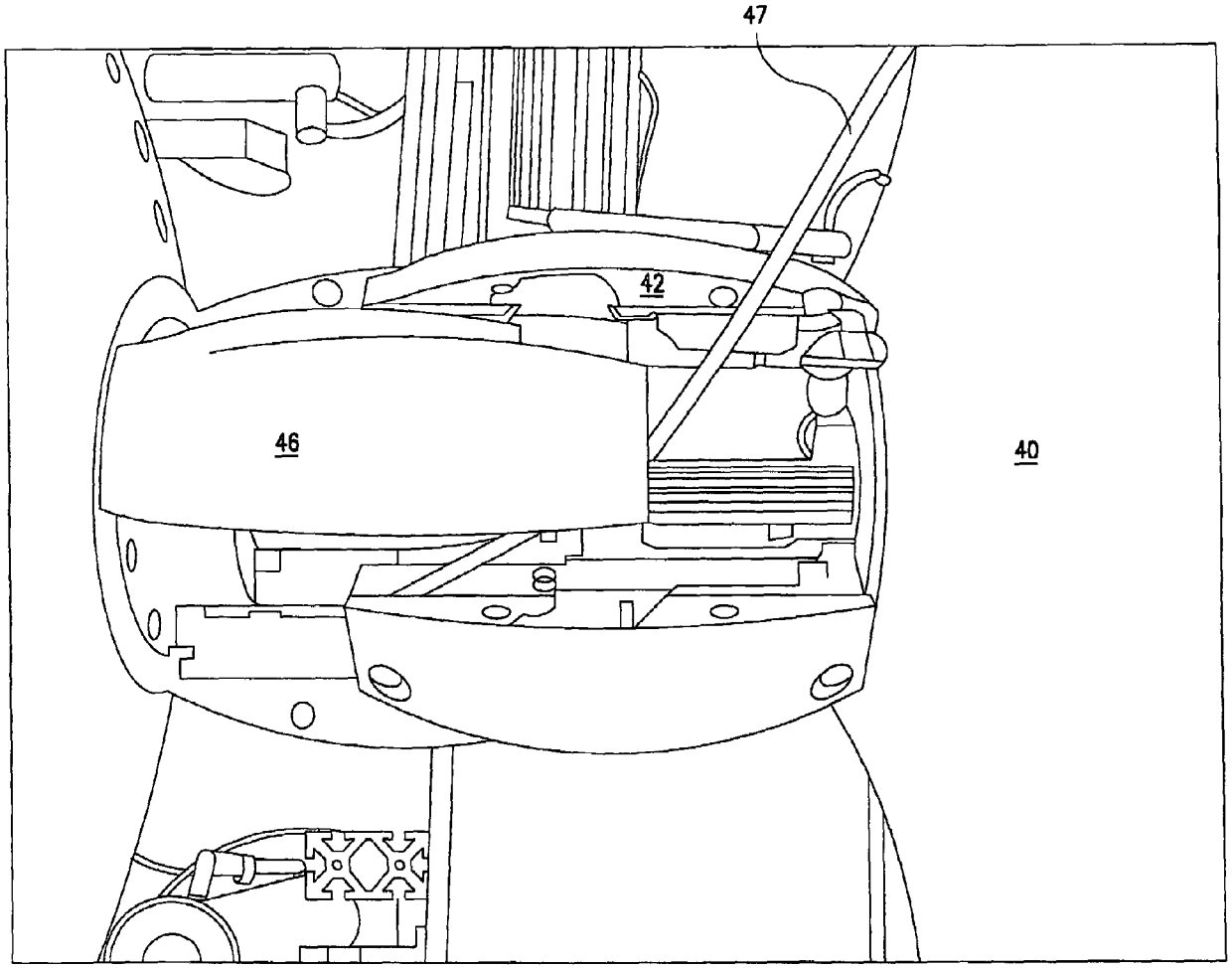
FIG. 4 illustrates the entry of the collapsible mandrel on the opposing mandrel and end form which is being moved into interleaving relationship with the mandrel and end form illustrated in FIGS. 5 and 6 and whereby the filamentary material is being pushed toward the latching mechanism on the first mentioned end form, with the collapsible mandrels being further engaged as the second collapsible mandrel is pushed further into engagement with the first mentioned collapsible mandrel and the filamentary material firmly engaged in the latch at the base of the end form and with the collapsible mandrels fully engaged.
Figure 5:
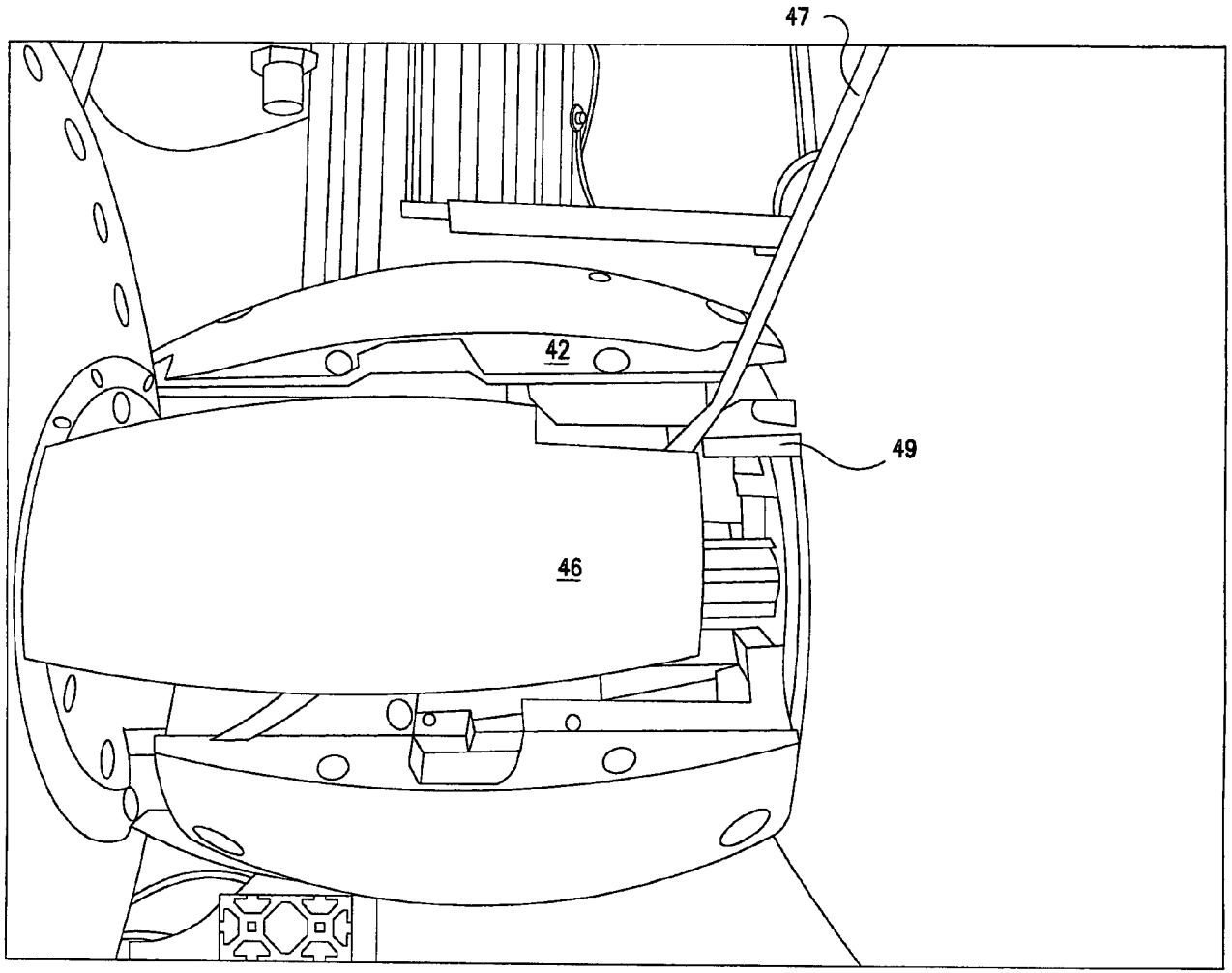
Figure 6:
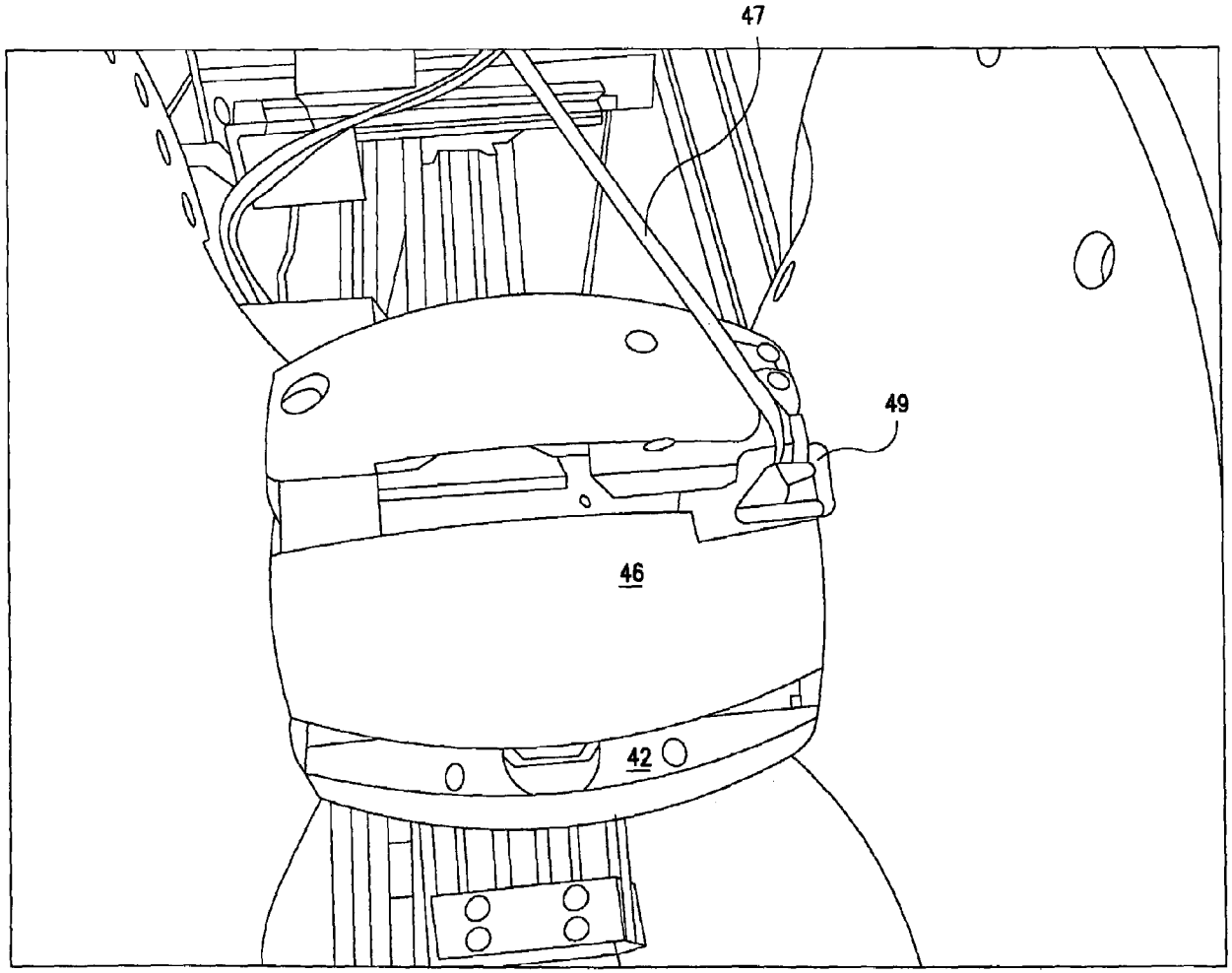

Once a coil has been wound, the end of the coil is grasped and severed by a mechanism and technique well known to those skilled in the winding art, and the free end of the coil is moved into the vicinity of the open jaws of a clamping mechanism shown in FIG. 2 and which is located on one end of a collapsible mandrel 44 shown in FIG. 2. As shown in FIG. 3, the free coil end is clamped between the jaws of the clamping mechanism and the filamentary material is pushed toward the end form and a filamentary material grabber mechanism 49 as illustrated in FIGS. 5 and 6.

As is more fully described hereinafter, once a wound coil is located at the boxing station and within a partially formed container, a payout tube is inserted through a top panel of the container having an appropriate payout tube hole located therein and into the radial hole formed in the wound coil so that a free end of the filamentary material is withdrawn through the radial hole and the payout tube so that the filamentary material can be unwound from the inside of the coil (The REELEX method, proprietary to Windings and as represented by the above-mentioned patents).

Figure 7:
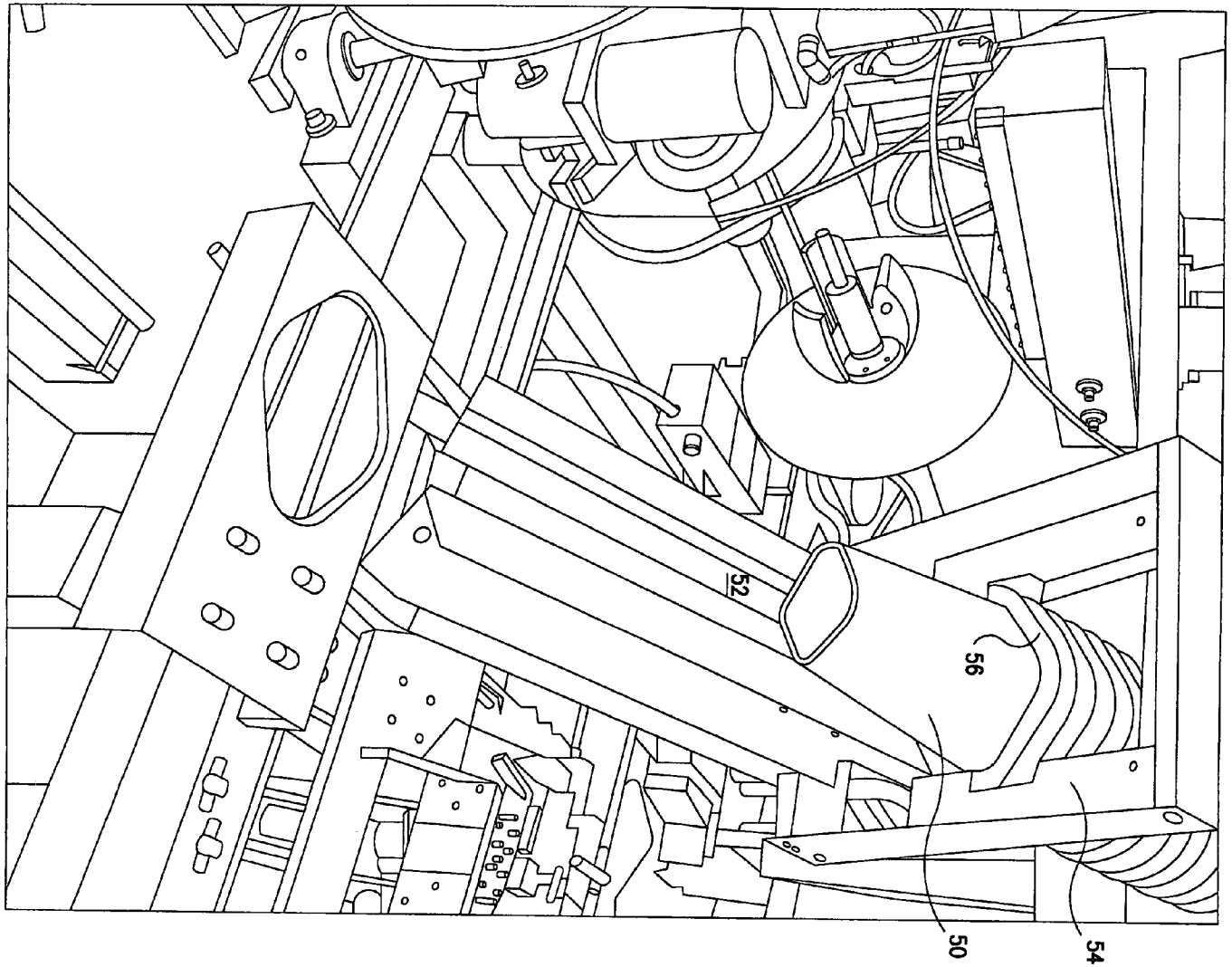
FIG. 7 is a perspective view of the payout tube supply source.

FIG. 7 illustrates the plastic payout tube supply source used in the present invention and which comprises a number of stacked payout tubes 50 positioned on an inclined ramp 52 and retained by a gate mechanism 54 which is appropriately activated to enable a single plastic payout tube to be released to slide downwardly toward a payout tube retainer, whereby each plastic payout tube is held with the flange 56 thereof resting on top of the retainer 54 and the entrance of the plastic payout tube extending downwardly.

Figure 8:
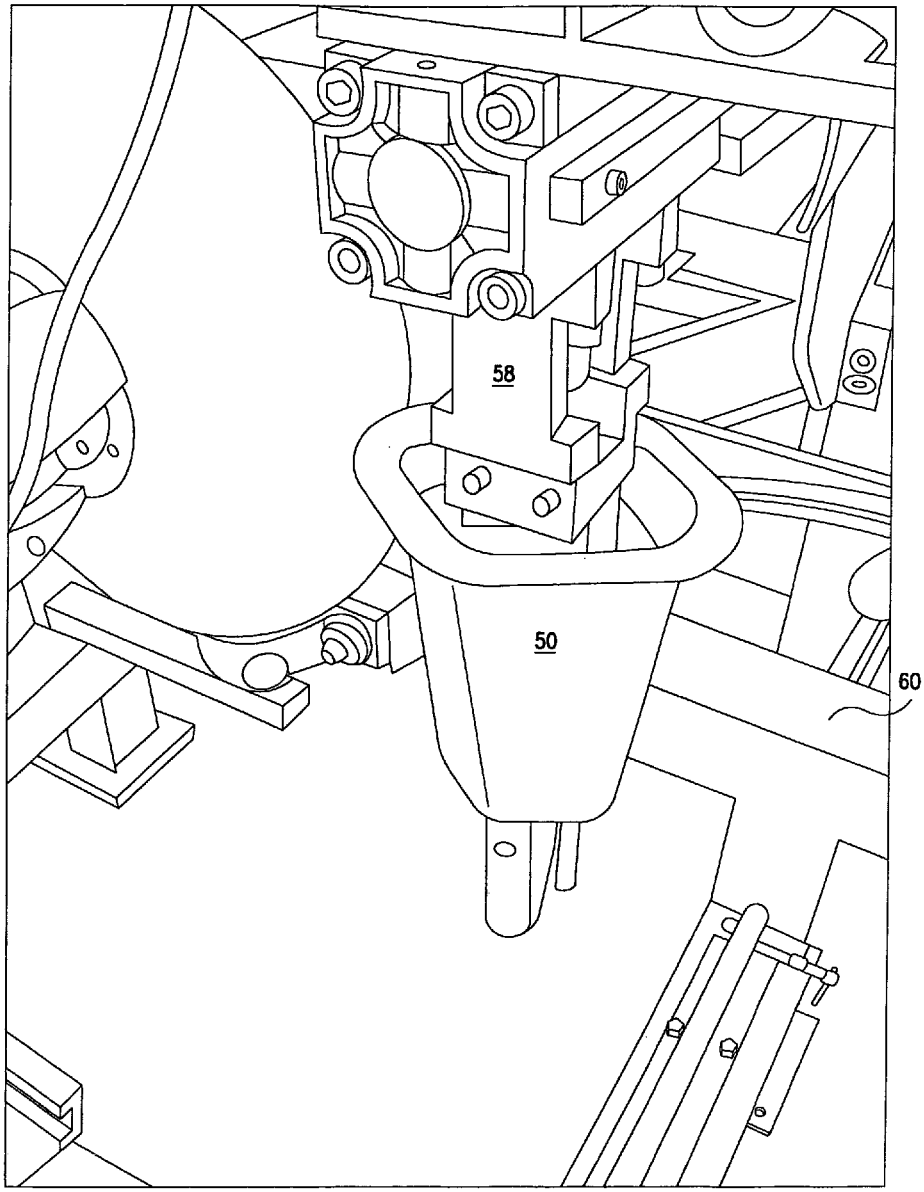
FIG. 8 illustrates the insertion payout tube holding structure, including the filamentary grasping component.

Each individual plastic payout tube in retainer 54 is engaged by a payout tube insertion mechanism is located above the payout tube retainer mechanism and is slid into the plastic tube 50 and which includes a movable rod 60 extending below the bottom of the payout tube 50 and immediately adjacent a fixed portion of the payout tube insertion mechanism as illustrated in FIG. 8.

Figure 9:
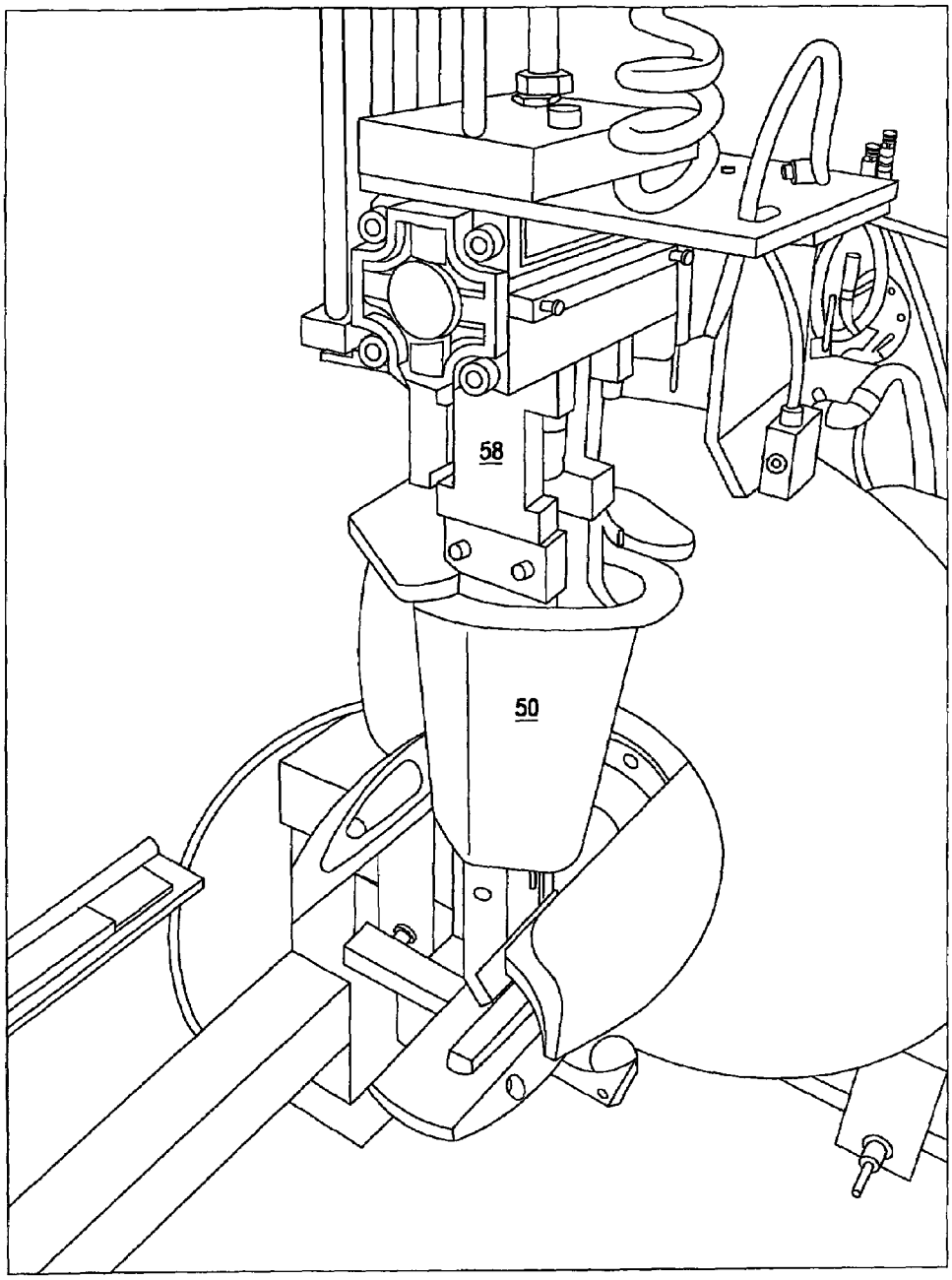
FIG. 9 illustrates the payout tube insertion and filamentary material grasping mechanism in relation to the mandrel but absent the wound coil for purposes of clarity.

FIG. 9 is an explanatory view of the payout tube insertion mechanism and an expanded mandrel but absent the wound coil to illustrate the manner in which the payout tube insertion mechanism 58 coacts to achieve its purpose of deposition the plastic payout tube and simultaneously there-with is able to engage the free inner end of the wound filamentary material. The insertion of the payout tube insertion device into and through the radial payout hole in the wound coil of filamentary material enables the movable rod 60 to squeeze the coil end such that it may be extracted from the wound coil and through the payout tube, which is now engaged with the radial payout hole of the wound coil.

Figure 10:
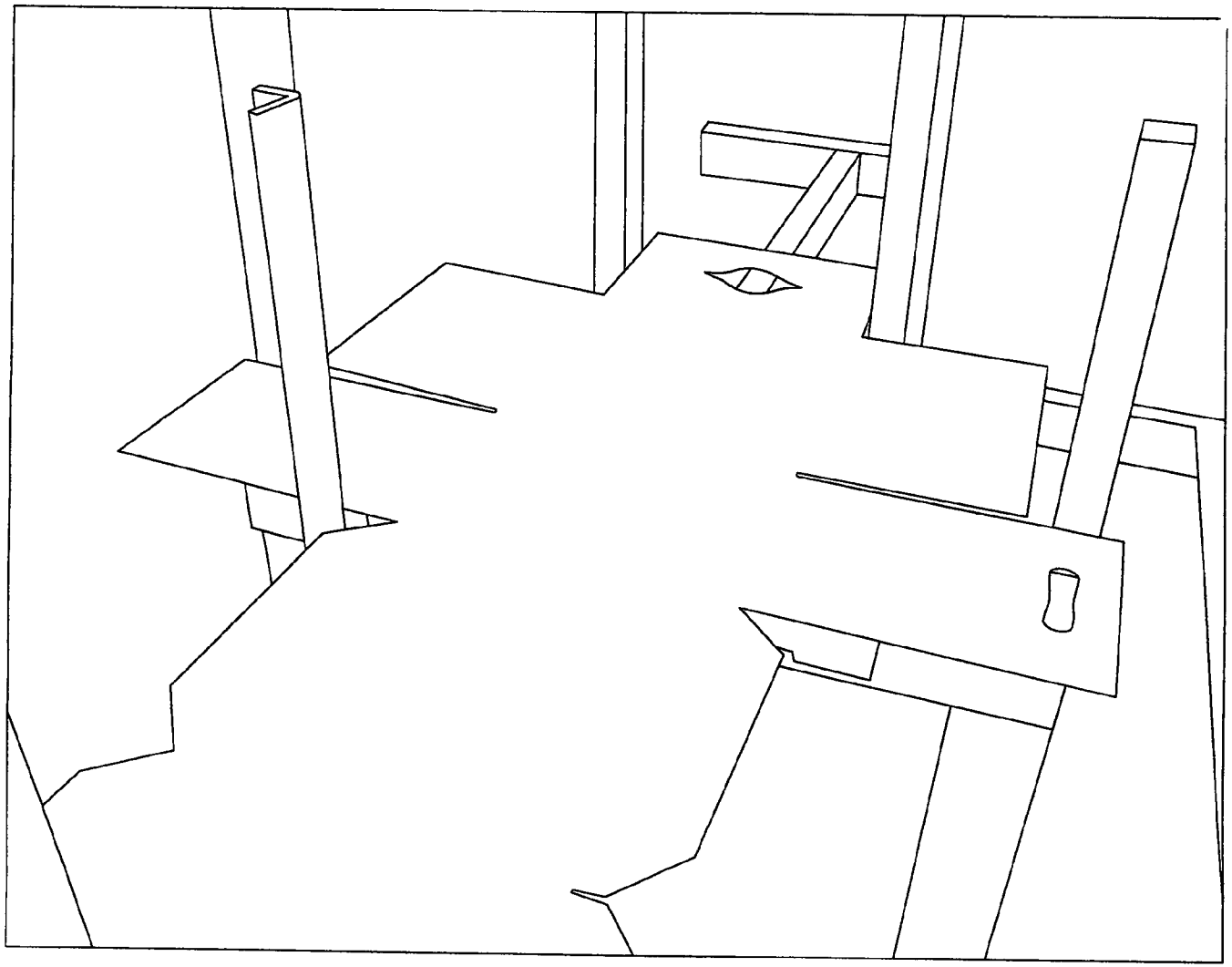
FIG. 10 illustrates the container magazine storage station of the boxing apparatus of the invention.

The unfolded containers are stored in a box magazine such as that illustrated in FIG. 10. The individual boxes are transported from the magazine storage area to the boxing station (described more fully below) via a number of vacuum suction cups (not illustrated) that engage an individual container and lift it to the boxing station were it is released onto the boxing station in position to be folded and receive the wound coil.

Figure 11:
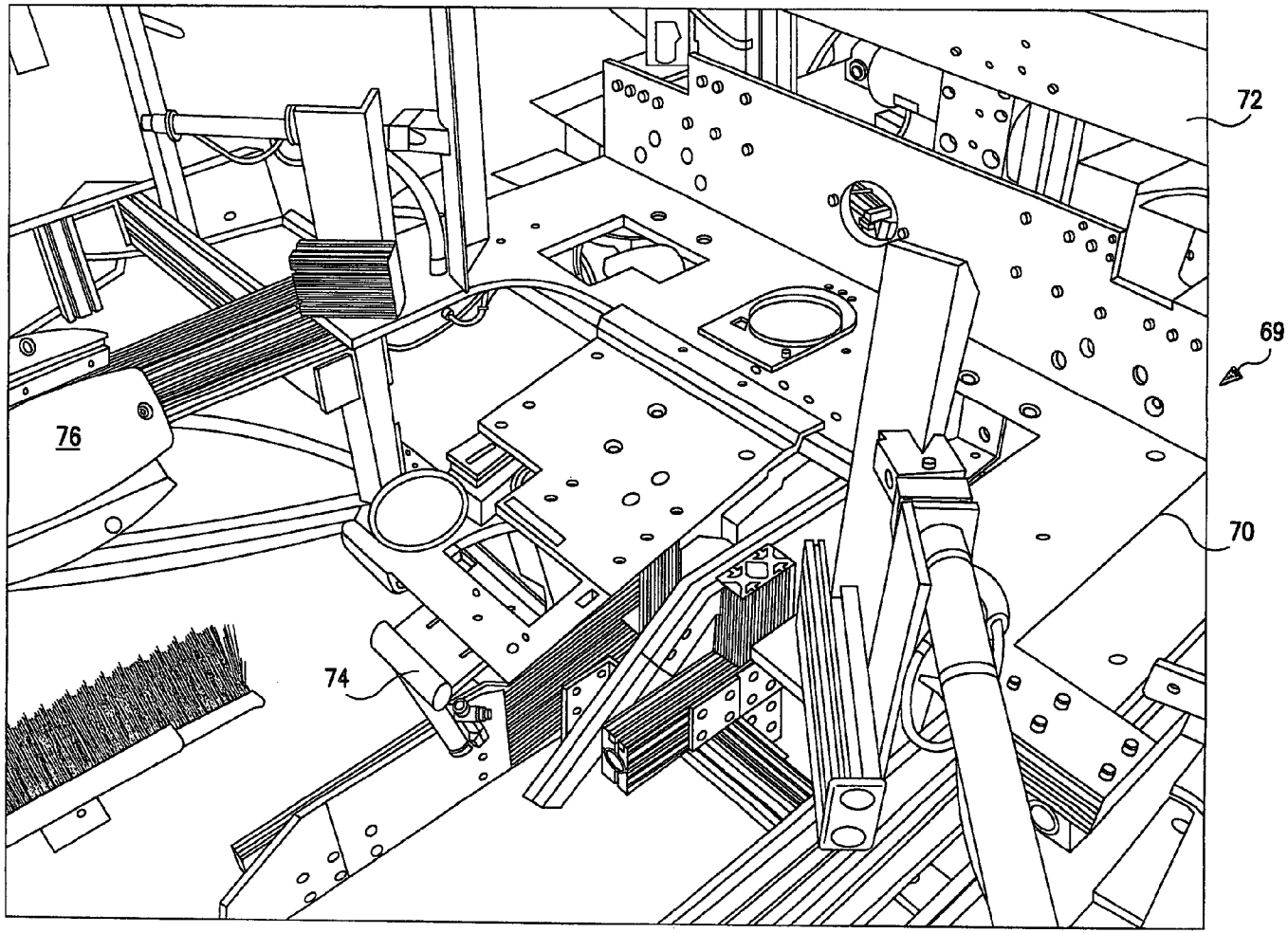
FIG. 11 shows the boxing station which receives individual containers and the individual wound coils for boxing and which includes the necessary movable components to rotate the container flaps and gluing mechanism to enclose the wound coil in a completely formed container.

The boxing station 69 is shown in FIG. 11 and includes a floor member 70, a back member 72 and a vertically movable ramp member 74 facing a collapsible mandrel, which in normal operation, would include a wound coil to be boxed. When an unfolded container is placed in the box station by the previously described vacuum cups, a back panel is lifted by engagement with back member 72 so that it assumes a vertical position with a bottom panel of the container resting on floor member 70. Movable front flap 74 serves to fold over the front flap of the container after the wound coil is inserted in the partially assembled container (not shown).

Figure 12:
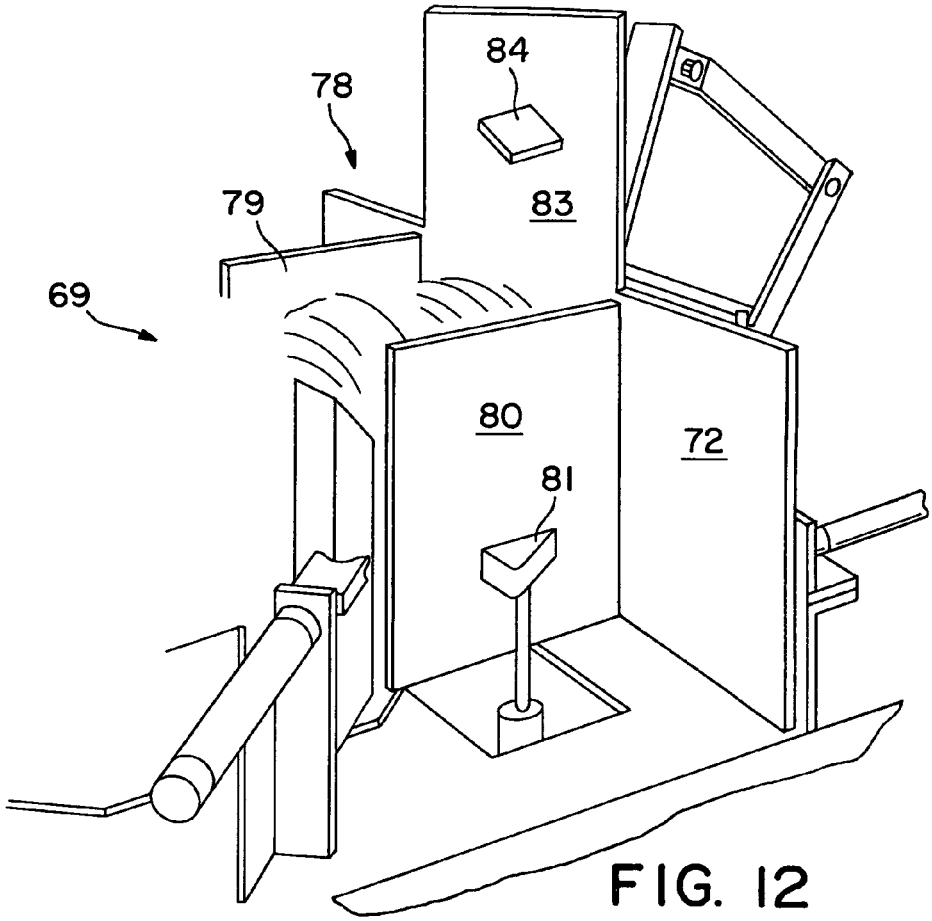
FIG. 12 shows the wound coil positioned in the partially formed container by rotation of the end form and mandrel on which the filamentary material was wound (not illustrated for clarity)

The boxing station 69 shown in FIG. 12 illustrates the wound coil positioned in partially formed container 78 by rotation of the turret 36 and the associated end form and mandrel (FIG. 1, also reference mandrel 76 in FIG. 11) into confronting relationship with the boxing station, and more particularly inclined ramp 74. The mandrel 76 is lowered and the boxing station moved forward so that the wound coil is inserted in the partially formed container as shown in FIG. 12 with side panels 79 and 80 of the container being raised as illustrated. One of the elements for engaging the side panel 80 is shown in the Fig. A corresponding element exists on the opposite side of the container for elevating side panel 79.

Figure 13:
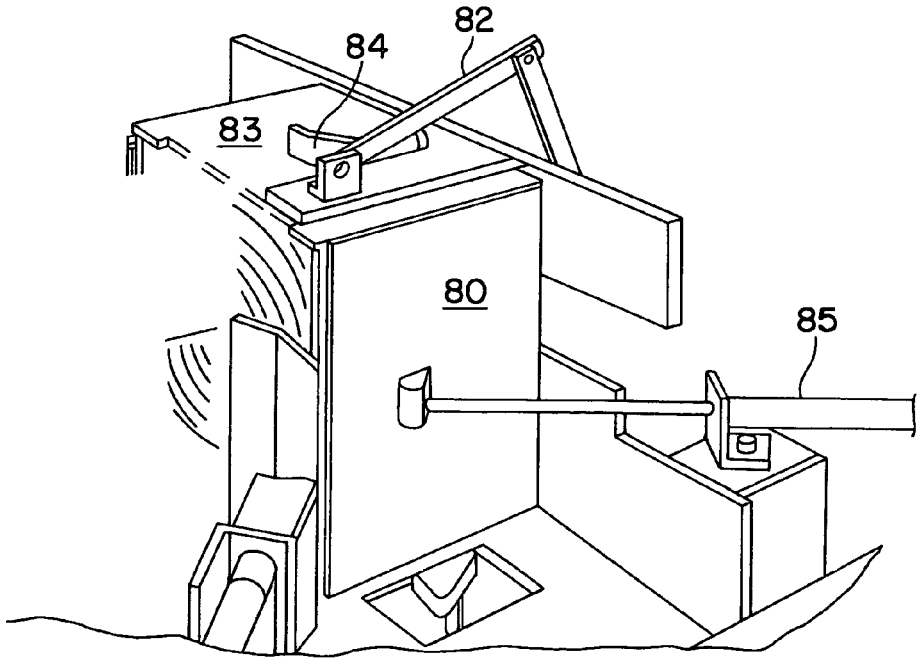
FIG. 13 shows the top panel of the container containing the payout tube opening being placed over the coil.

In FIG. 13 element 82 closes a top panel 83, including payout tube opening 84 of the container. Back panel 72 is lowered thereby enabling element 85 to engage and support side panel 80. A similar element on the other side of the container supports side panel 79.

Figure 14:
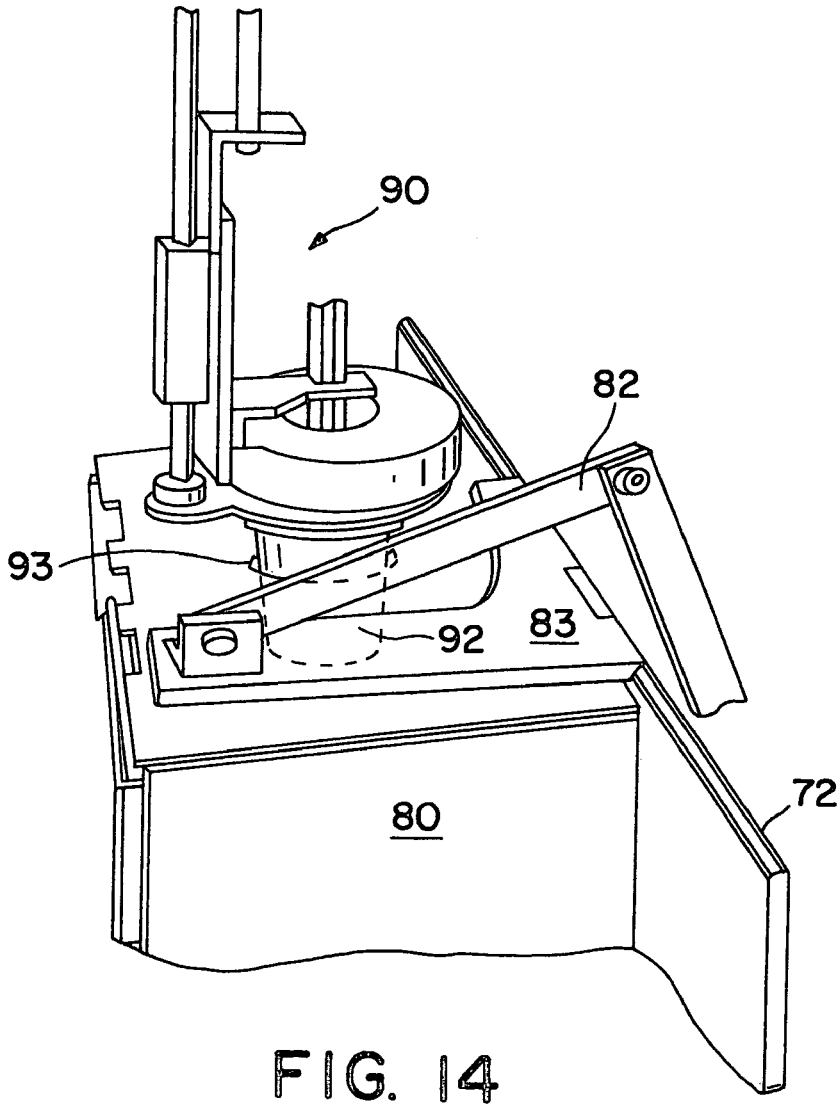
FIG. 14 shows the payout tube insertion mechanism being inserted in the payout tube opening in the top panel of the container and into the payout tube of the wound coil of filamentary material.
Figure 14A:
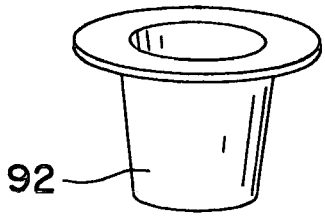
FIG. 14A is detail view of the payout tube.

FIG. 14 illustrates the payout tube insertion mechanism 90 inserting a payout tube 92 in the payout tube opening 93 in the top panel 83 of the container and the radial opening in the wound coil. A typical plastic payout tube is shown in FIG. 14A.

Figure 15:
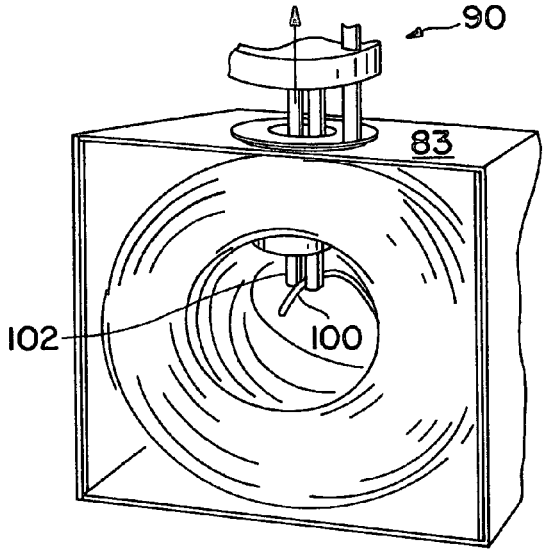
FIGS. 15 and 16 illustrate the manner in which the end of the wound coil is grasped by the payout tube insertion mechanism and withdrawn from the wound coil and the container (FIG. 18) as the top panel is restrained from movement.
Figure 16:
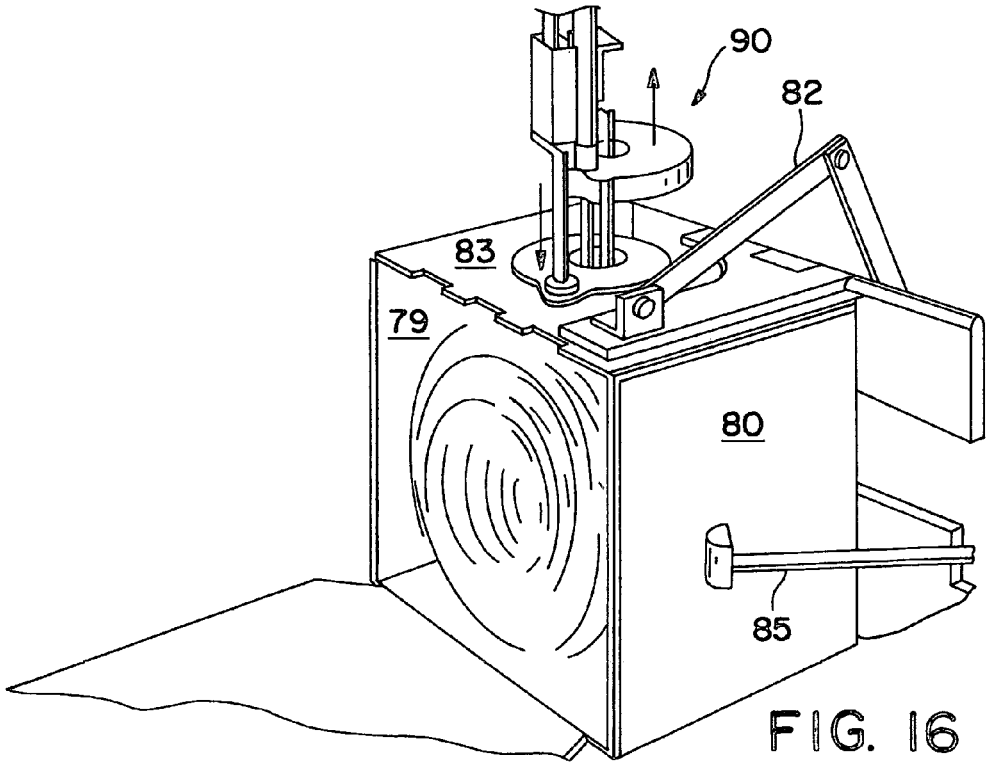

FIGS. 15 and 16 illustrate the manner in which the end of 100 of the wound coil is grasped by fingers 102 of the payout tube and insertion mechanism as it is withdrawn from the top panel 83. As shown in FIG. 16 element 82 prevents top panel 83 from lifting as the payout tube insertion mechanism 90 is raised.

Figure 17:
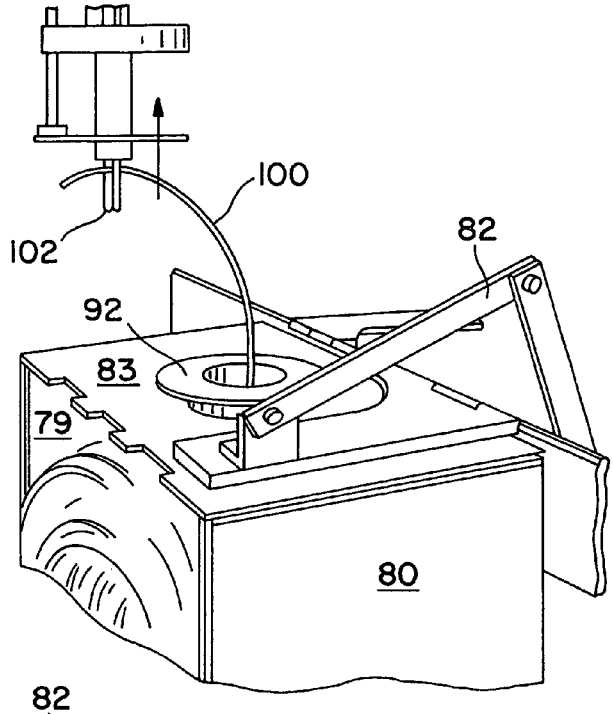
FIG. 17 illustrates the complete withdrawal of the payout tube insertion mechanism from the wound coil and the container while grasping the free end of the wound coil.
Figure 18:
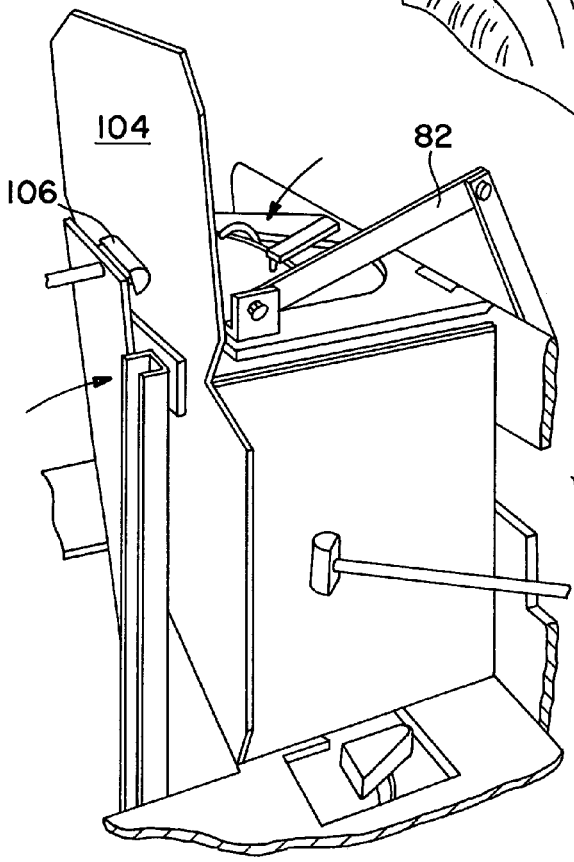
FIG. 18 illustrates the top closure panel of the container posed to be formed over the top of the container.
Figure 19:
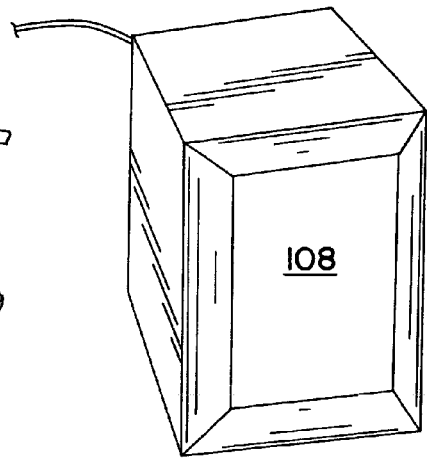
FIG. 19 illustrates a completely sealed container.

In FIG. 17 the payout tube insertion mechanism has cleared the payout hole in top panel 83 with the end 100 of the wound coil grasped between fingers 102. In FIG. 18 a further top panel is being bent over by element (with the withdrawal of element 82) to secure the payout tube. Subsequently automatically operated gluing mechanisms glue appropriate portions of the side panels and the completed container is shown in FIG. 19 with end 100 of the wound coil projecting from the container, thereby enabling the filamentary material to be withdrawn through the radial opening and the payout tube.

It is desired that the present invention not be limited to the embodiments specifically described, but that it include all such modifications and variations that would be obvious to those skilled in this art. It is my intention that the scope of my invention should be determined by any and all equivalents of the various terms and structure as recited in the following annexed claims.

What is claimed is:

1. A machine for winding and boxing wound coils of filamentary material having a payout hole extending from the outer to the inner coil winding, comprising:

a turret mechanism for mounting two oppositely disposed end forms and corresponding collapsible mandrels; said turret mechanism being operative between first and second stations, wherein said first station enables filamentary material to be wound on one of said mandrels and associated end form to produce a payout hole in the winding and leave an end of the wound coil free and said second station wherein the mandrel and end form containing the wound coil is rotated to confront a boxing station; said second station further including a coil arm having a payout hole spreader mounted thereon for engaging the free end of the wound coil and supporting the wound coil;

means for storing payout tubes and inserting a payout tube in the payout hole of the wound coil;

a boxing station including a packaging state table for receiving an unfolded container and the wound coil and including means for folding the flaps of the box around the wound coil said container including a top panel with a payout hole folded in alignment with the payout hole in the wound coil;

means extending into the payout hole for grabbing the free end of the wound coil and withdrawing it through the payout tube; and means for folding, gluing and sealing the flaps of the box.

2. A machine for winding and boxing wound coils of filamentary material according to claim 1, wherein the coil arm comprises a cradle adapted to receive a wound coil and movable to position the wound coil over the coil arm for engagement with the payout hole spreader.

3. A machine for winding and boxing filamentary material according to claim 2, wherein the hole spreader comprises a bifurcated upstanding post inserted within the radial hole of said wound coil and including an aperture for engaging the free end of said wound coil so the free end extends exposed between the bifurcated post.

4. A machine for winding and boxing filamentary material according to claim 3, wherein the coil arm automatically moves into the packaging stage table after the wound coil is mounted over the payout hole spreader.

5. A machine according to claim 1, wherein the means for storing payout tubes including a tube holder and a collator for properly orienting the tubes to be retained in said tube holder.

6. A machine for winding and boxing filamentary material according to claim 5, wherein the means for inserting payout tubes is movable to be positioned over the radial payout hole of a wound coil mounted on the coil arm and a flap of the container including an opening for receiving the payout tube and including means for grabbing a payout tube from said tube holder and inserting said payout tube into said opening and said radial payout hole.

7. A machine for winding and boxing filamentary material according to claim 6, wherein said means for grabbing including a wire grabber for grabbing the inner end of the wound coil extending between the hole spreader and extracting the inner end of the wound coil through the payout tube.

8. A machine according to claim 1, wherein the means for folding successively folds individual flaps of the box to enclose the wound coil and further includes means for applying glue to selected portions of said flaps.

9. A machine for winding and boxing filamentary material according to claim 1, further comprising means for conveying a box containing a wound coil form said boxing machine.

* * * * *